United States Patent [19]

Robertson, III

[11] Patent Number: 4,955,997

[45] Date of Patent: Sep. 11, 1990

[54] FLUSH MOUNTED CEILING AIR CLEANER

[76] Inventor: Elmer W. Robertson, III, 3209 Springwood Dr., Jonesboro, Ark. 72401

[21] Appl. No.: 349,811

[22] Filed: May 10, 1989

[51] Int. Cl.[5] ..... B01D 50/00

[52] U.S. Cl. ..... 55/316; 55/385.2; 55/467; 55/473; 98/33.1; 98/40.1

[58] Field of Search ..... 55/316, 467, 473, 385.2, 55/DIG. 29; 98/34.5, 33.1, 31.5, 40.1, 40.05

[56] References Cited

U.S. PATENT DOCUMENTS

| | | | |
|---|---|---|---|
| 3,143,952 | 8/1964 | Simons | 55/DIG. 29 |
| 4,023,472 | 5/1977 | Grunder et al. | 55/DIG. 29 |
| 4,531,454 | 7/1985 | Spoormaker | 98/33.1 |
| 4,539,896 | 9/1985 | Thomas | 98/33.1 |
| 4,684,381 | 8/1987 | Wasylyniuk | 55/316 |
| 4,722,747 | 2/1988 | Armbruster | 55/316 |

FOREIGN PATENT DOCUMENTS 3719734 12/1988 Fed. Rep. of Germany ..... 55/385.2

*Primary Examiner*—Jay H. Woo
*Assistant Examiner*—James P. Mackey
*Attorney, Agent, or Firm*—Nixon & Vanderhye

[57] ABSTRACT

An air cleaner device with the return grill and supply grill separated by a length of flexible insulated hose. The length of separation is sufficient to achieve maximum air circulation within the room. Multiple supply grills may be used to achieve more extensive air circulation requirements. The main filter compartment consists of a sheet metal cabinet housing containing motor, blower, filters, and hinged filter access door that also serves as a return grill for air to enter unit for filtration. The flexible insulated hose is connected to the main filter compartment by the use of a hose collar and secured by the use of hose clamps to achieve an air tight connection. The flexible insulated hose is connected to one or more supply grills in the same manner as it is connected to the main filter compartment.

17 Claims, 3 Drawing Sheets

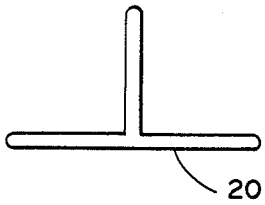
FIG. 1A
FIG. 2 (PRIOR ART)
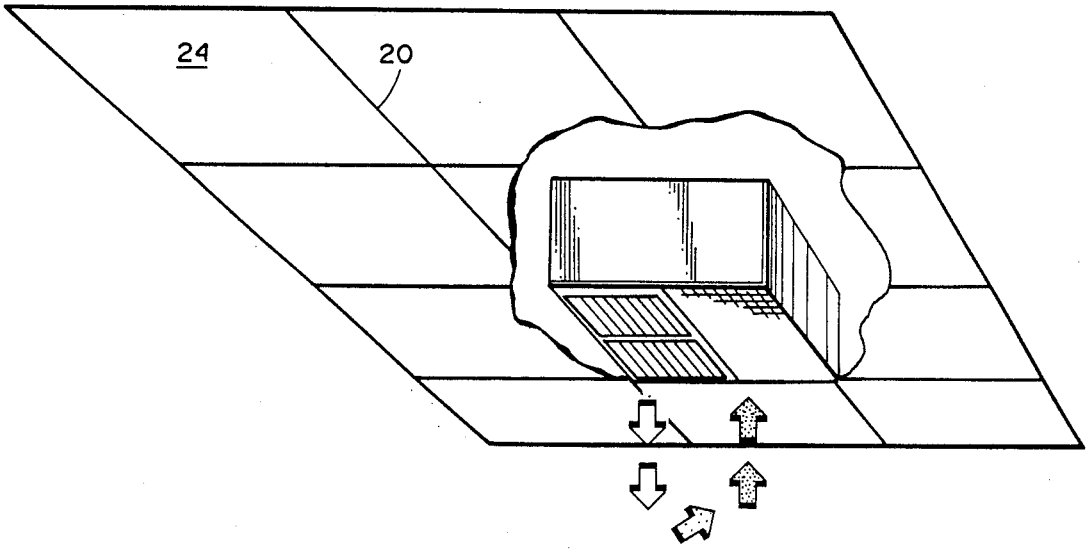

FLUSH MOUNTED CEILING AIR CLEANER

BACKGROUND AND SUMMARY OF THE INVENTION

The flush mounted ceiling air cleaner of the present invention is an improvement of existing flush mounted ceiling air cleaners.

Flush mounted ceiling air cleaners are typically designed to fit inside the supporting bars of a suspended ceiling framework. The frame work consists of these supporting T bars that intersect in a uniform pattern every 24" in one direction, and every 24" or 48" in a direction perpendicular to the first. The resultant open space available between each bar to place a flush mounted ceiling air cleaner is either 23¾"×23¾" or 23¾"×47¾". Prior to the present invention, flush mounted ceiling air cleaners were limited to accepting dirty air, cleaning this air, and discharging this same air within the confines of either a 2 ft.×2 ft. or 2 ft.×4 ft. ceiling grid opening. This resulted in inadequate circulation of the cleaned air into the remote areas of the room in which it operated. The effect of this inadequate circulation was that clean air discharged by the air cleaner reentered the unit at the intake of the air cleaner creating a "short circuiting" effect of the clean air. This resulted in clean air becoming localized in the immediate vicinity of the air cleaner.

The present invention eliminates this problem by locating the supply of clean air at a location(s) remote to the location of the intake of dirty air. This is accomplished by the use of a flexible insulated hose which connects the remote clean air supply grill to the main cabinet which receives and cleans the dirty air. By the use of a remote supply grill(s), air patterns can be established in a room which will allow for optimum cleaning of the air within the room and increase the overall cleaning efficiency of the air cleaner by allowing a higher percentage of dirty air to enter the unit for cleaning.

By separating the supply grill(s) from the return grill with at least 12 ft. of flexible hose, air patterns can be established that meet the user's specific requirements. Filtered air can be introduced at any point in the room without having to locate the main body of the air cleaner at that point. By the use of multiple supply grills and hoses, several points in a given area can be directly supplied with filtered air simultaneously.

An additional advantage is gained by separating the supply grill from the return grill. The logarithmic addition of noise as measured in decibels is reduced. When the supply and return grills are located within the same T-bar ceiling grid, air noise generated by both grills combine to create a decibel level greater than that created by each separate grill. The result of separating the supply and return grills will reduce the total decibel level at any one location in the room.

By the use of flexible insulated hose, air noise generated by the blower wheel and motor is attenuated by the absorption of this noise by the insulated hose before it reaches the supply grill. Without the insulated flex hose, blower noise is transmitted directly into the room.

By the use of flexible insulated hose in combination with multiple supply grills, separate rooms may be supplied with filtered air without having to locate the main body of the air cleaner in each room. This reduces the number of separate air cleaners required to effectively clean a multi-room facility.

The present invention allows the user to remove and replace filters from the room below the unit. The primary filters are retained independently of the prefilter allowing frequent removal of the prefilter without having to remove the primary filters.

BRIEF DESCRIPTION OF THE DRAWINGS

FIG. 1A is a cross section of a standard ceiling grid T of the type shown in FIG. 1.

FIG. 2 is a perspective view of conventional ceiling flush mounted air cleaners showing how clean air can re-enter the unit before adequate circulation is accomplished.

DETAILED DESCRIPTION OF THE DRAWINGS

Figure 1:
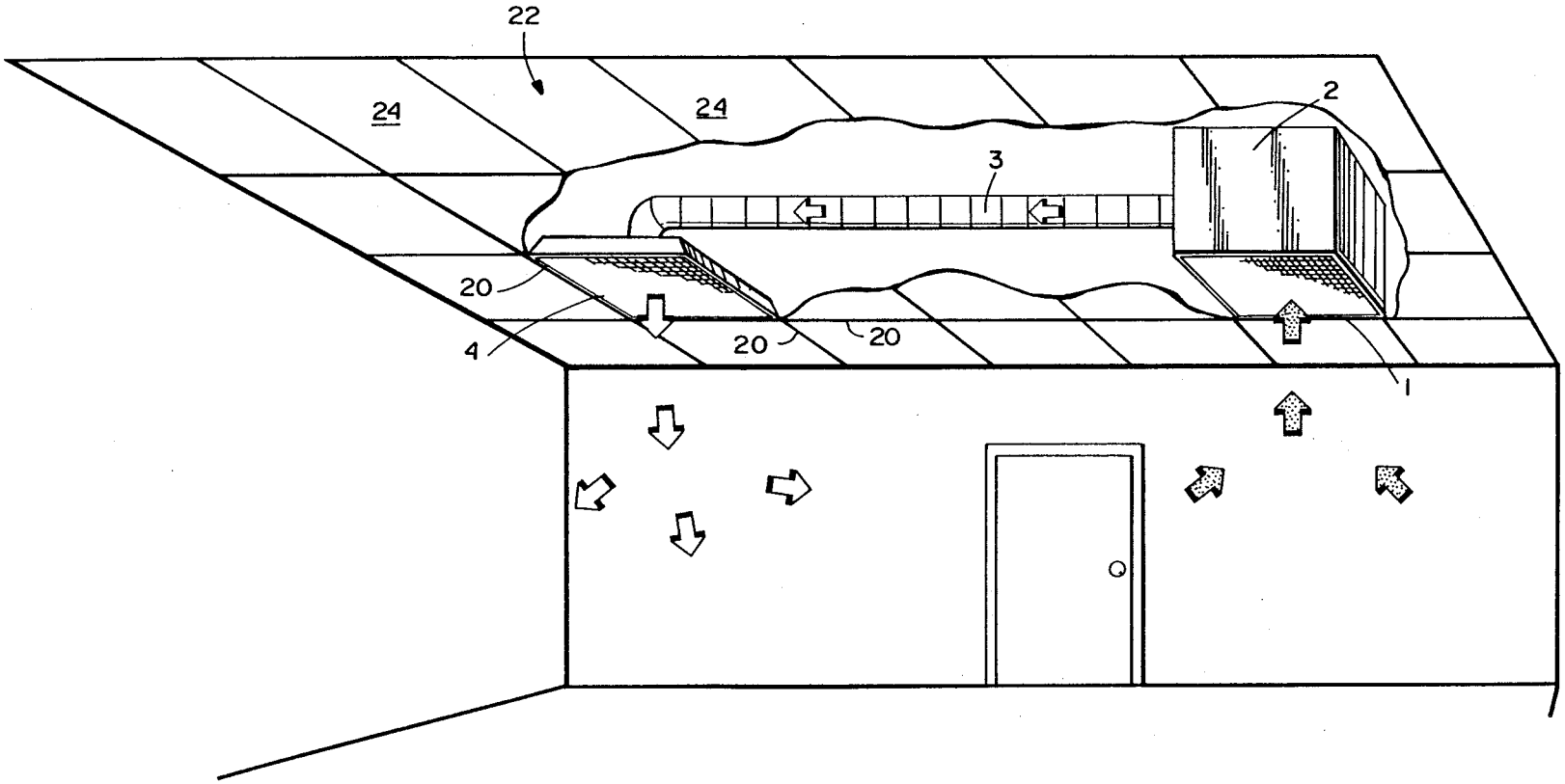
FIG. 1 is a perspective view of the present invention showing the separation of the supply and return grills connected by insulated flex hose.

The flush mounted ceiling air cleaner of the present invention is shown in FIG. 1 in the installed position with the return grill 1, filtering section 2, flexible insulated connecting hose 3, and supply grill 4 from which clean air is discharged into the room. The return grill 1 and filtering section 2 are enclosed within a cabinet or housing 2', and it will be appreciated that the return grill 1 is located at an outermost end of an inlet side of the cabinet or housing, and the flexible connecting hose 3 is connected to the cabinet or housing at the outlet side thereof. Thus, room air entering the return grill 1 flows through the filtering section 2, connecting hose 3 and is discharged back into the room through the supply grill 4 at a location remote from the return grill 1.

Figure 3:
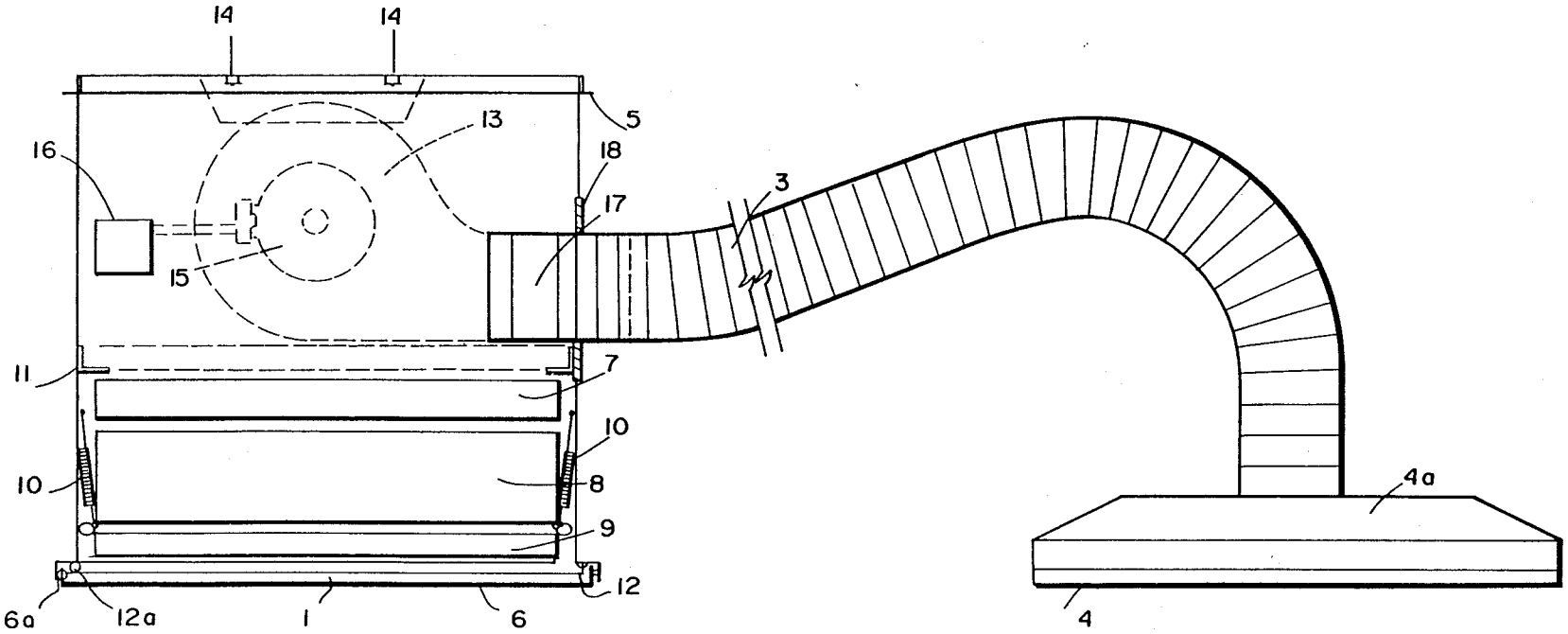
FIG. 3 is a detailed side view of the present invention showing hose and grill connection and details of filter retention and ability to remove filters from the room below the unit.

The flexible hose is connected to the return grill 1 and filtering section 2 to form an air tight seal. The supply grill 4 is at an outermost end of a plenum chamber **4*a* and is designed to fit into a ceiling grid 2'×2' section and rest in place without any support from above. The filtering section 2 is designed to hang from a support structure above the air cleaner. A hanging flange 5 is provided as shown in FIG. 3. Threaded rod, cable, or chain (not shown) is used to suspend the cabinet so that the return grill is positioned to fit into a ceiling grid 2"×2' section. The return grill 1 is incorporated into a hinged filter access door 6 as shown in FIG. 3 (hinged at 6*a*), and is held in a closed position with a latching mechanism. Filters are removed by opening the filter access door 6 from the room below. The filtering section houses three filters which include an activated charcoal filter 7 for gaseous and odor removal, a particulate filter 8 for removal of smaller particles from the air, and a prefilter 9 for removal of larger particles from the air. The charcoal filter and particulate filter are held in position by the use of springs 10 which seal the filters against a sealing flange 11. The prefilter is held in position by the use of a separate retainer bar 12. This retainer bar is hinged at 12*a* to swing down for prefilter removal without having to remove the filters 7 and 8**.

The blower 13 is mounted with rubber vibration isolators 14 to the cabinet walls. The motor 15 is mounted to the blower directly driving the blower wheel (not shown). Electrical wiring is terminated at the electrical junction box 16. The blower outlet is connected to the cabinet wall by the use of a vibration isolator 17. A supporting hose collar 18 is attached to the outside wall. The flexible hose 3 is attached to this hose collar and secured with a hose clamp. The flexible hose 3 is attached to the supply grill 4 in the same manner.

In use, the air cleaner system of this invention is preferably mounted in conjunction with a conventional suspended ceiling structure. In such an arrangement, a framework of inverted T-shaped members 20 are arranged to form a series of rectangular or square grids 22 which support ceiling tiles or the like 24. In this invention, and as shown in FIG. 1, the return air grill 1 is located above a second grid, remote from the first grid, but substantially co-planar therewith. This arrangement optimizes room air flow and the cleaning efficiency of the apparatus.

Thus there has been shown and described the flush mounted ceiling air cleaner which accomplishes at least all of the stated objectives.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

I claim:

1. An air cleaner adapted for flush mounting in a suspended ceiling system comprising:

(a) a cabinet enclosing a blower, a blower motor and a plurality of filters, the cabinet having an attachment flange for securing the cabinet to a ceiling support structure, the cabinet including a return air grill located at an outermost end of an inlet side thereof upstream of said plurality of filters, and corresponding in size substantially to a first standard ceiling grid;

(b) at least one plenum chamber having a supply air grill at an outermost end of said plenum chamber and corresponding to in size, and adapted to be supported on, a second standard ceiling grid; and (c) a flexible conduit connecting said cabinet and said supply air grill, said conduit connected to an outlet side of said cabinet downstream of said plurality of filters, and having a length sufficient to permit said cabinet and supply air grill to be located remote from each other.

2. The air cleaner according to claim 1 wherein said plurality of filters includes an activated charcoal filter, a particulate filter and a prefilter, located, respectively, one above the other.

3. The air cleaner according to claim 1 wherein said return air grill comprises a hinged filter access door openable from a room below said ceiling.

4. The air cleaner according to claim 2 wherein said cabinet includes a sealing flange, and wherein spring means are employed to hold said charcoal filter and said particulate filter in position against said sealing flange.

5. The air cleaner according to claim 4 wherein said prefilter is held in place by a retainer bar enabling said prefilter to be removed separately from said particulate filter and said charcoal filter.

6. The air cleaner according to claim 1 wherein said blower includes a blower wheel and said motor is mounted to directly drive said blower wheel.

7. The air cleaner according to claim 1 and including vibration isolators disposed between said blower and said cabinet.

8. The air cleaner according to claim 1 wherein said return air grill and said supply grill each have substantially 2 ft.×2 ft. external dimensions and are adapted to fit within 2 ft.×2 ft. ceiling grids.

9. The air cleaner according to claim 1 wherein said flexible conduit is at least 12 ft. in length.

10. A ceiling mounted air cleaner system comprising:

a suspended ceiling structure including at least first and second standard grids;

air cleaner means including a housing enclosing a blower, a blower motor and a plurality of air filters, and a return air grill located at an inlet side of said housing, said housing positioned, within said first standard ceiling grid, in flush relationship relative to adjacent grids;

at least one plenum chamber having a room supply air grill mounted within said second standard ceiling grid remote from said first standard ceiling grid, also in flush relationship with adjacent grids; and air conduit means extending between an outlet side of said housing and said room supply air grill for carrying clean air from said air cleaner means to said plenum chamber and said room supply air grill.

11. The air cleaner system according to claim 10 wherein said plurality of filters includes a prefilter adjacent said return air grill, a particulate filter and a charcoal filter, said particulate filter and said charcoal filter being substantially vertically aligned with said prefilter.

12. The air cleaner system according to claim 10 wherein said standard ceiling grids measure substantially 2 ft.×2 ft.

13. The air cleaner system according to claim 10 wherein said return air grill is hinged for swinging movement to allow access to said plurality of air filters from a room below the ceiling.

14. The air cleaner system according to claim 10 wherein said air conduit means includes a flexible, insulated hose having a length of about 12 ft.

15. The air cleaner system according to claim 11 wherein said housing includes a sealing flange, and wherein spring means are employed to hold said charcoal filter and said particulate filter in position against said sealing flange.

16. The air cleaner system according to claim 10 and including vibration isolators disposed between said blower and said housing.

17. The air cleaner system according to claim 10 wherein said plurality of filters includes a prefilter adjacent said return air grill, a particulate filter and a charcoal filter, said particulate filter and said charcoal filter being substantially vertically aligned with said prefilter; wherein said standard ceiling grids measure substantially 2 ft.×2 ft.; and wherein said air conduit means includes a flexible, insulated hose having a length of about 12 ft.

* * * * *